United States Patent [19]

Scoates et al.

[11] Patent Number: 4,927,328

[45] Date of Patent: May 22, 1990

[54] SHROUD ASSEMBLY FOR AXIAL FLOW FANS

[76] Inventors: William D. Scoates; Samuel W. Scoates, both of Rte. 1, Box 930, Bryan, Tex. 77803

[21] Appl. No.: 430,185

[22] Filed: Nov. 1, 1989

Related U.S. Application Data

[63] Continuation-in-part of Ser. No. 317,903, Mar. 2, 1989.

[51] Int. Cl.[5] ..... F04D 29/68

[52] U.S. Cl. ..... 415/220; 415/208.1; 415/914; 123/41.49

[58] Field of Search ..... 415/182.1, 208.1, 220, 415/222, 914; 416/189; 123/41.49

[56] References Cited

U.S. PATENT DOCUMENTS

| | | | |
|---|---|---|---|
| 2,030,993 | 2/1936 | Langenkamp et al. | 416/189 R |
| 3,832,085 | 8/1974 | DeFauw et al. | 415/914 |
| 3,843,277 | 10/1974 | Ehrich | 415/119 |
| 4,406,581 | 9/1983 | Robb et al. | 416/228 |
| 4,432,694 | 2/1984 | Kuroda et al. | 415/914 |
| 4,515,071 | 5/1985 | Zach | 415/220 |
| 4,566,852 | 1/1986 | Hauser | 415/220 |
| 4,747,275 | 5/1988 | Amr et al. | 416/189 |

FOREIGN PATENT DOCUMENTS

| | | | |
|---|---|---|---|
| 119748 | 4/1945 | United Kingdom | 415/220 |

OTHER PUBLICATIONS

PCT WO85/02889, Jul. 1985.

*Primary Examiner*—Robert E. Garrett
*Assistant Examiner*—John T. Kwon
*Attorney, Agent, or Firm*—Vaden, Eickenroht, Thompson & Boulware

[57] ABSTRACT

An axial fan is disclosed that includes a hub supported for rotation around the longitudinal axis of the fan, a plurality of impeller blades attached to the hub and extending radially from the axis of rotation, a shroud assembly including a band encircling the blades and spaced from the tips of the blades a sufficient distance to provide ample clearance to avoid contact between the blades and the band during shipment and operation of the fan, the shroud further including an orifice positioned upstream of the blades for preventing air from flowing between the orifice and the band, the orifice having a downstream end located adjacent to but spaced from the impeller blades and having a diameter such that the impeller blades extend outwardly from the hub beyond the orifice so that the flow of air over the tips of the impeller blades is substantially reduced, which increases the efficiency of the fan.

3 Claims, 4 Drawing Sheets

FIG. 3
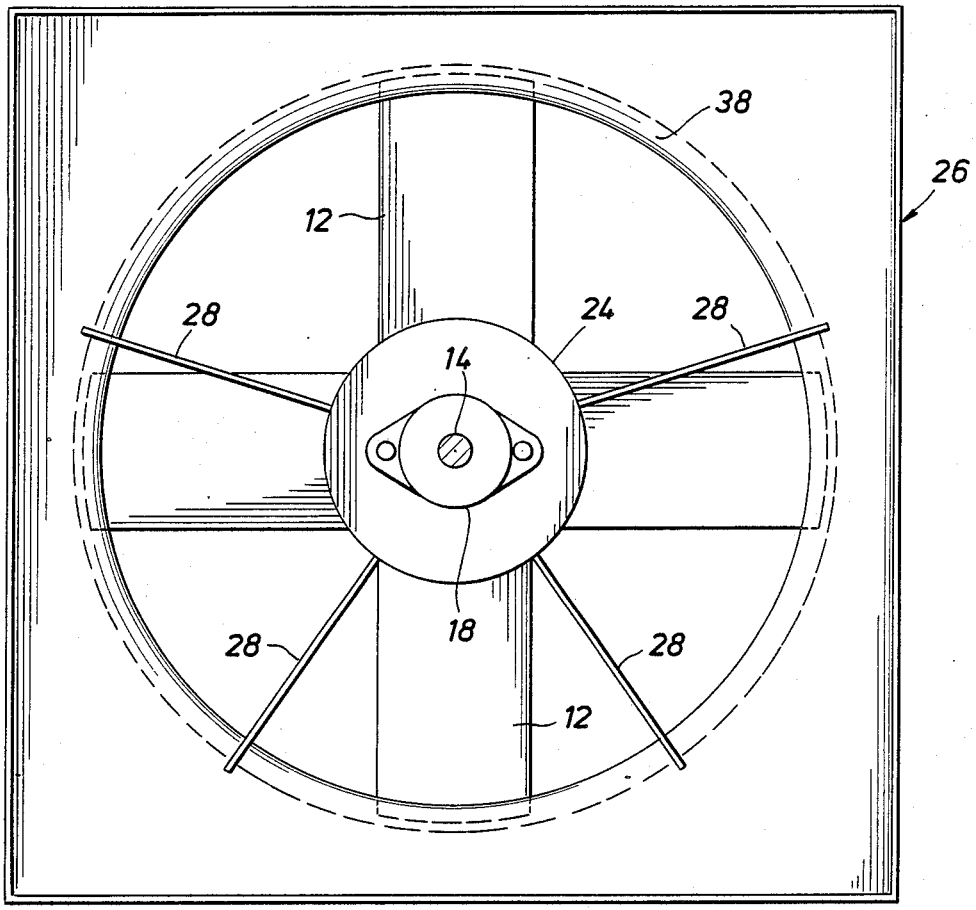
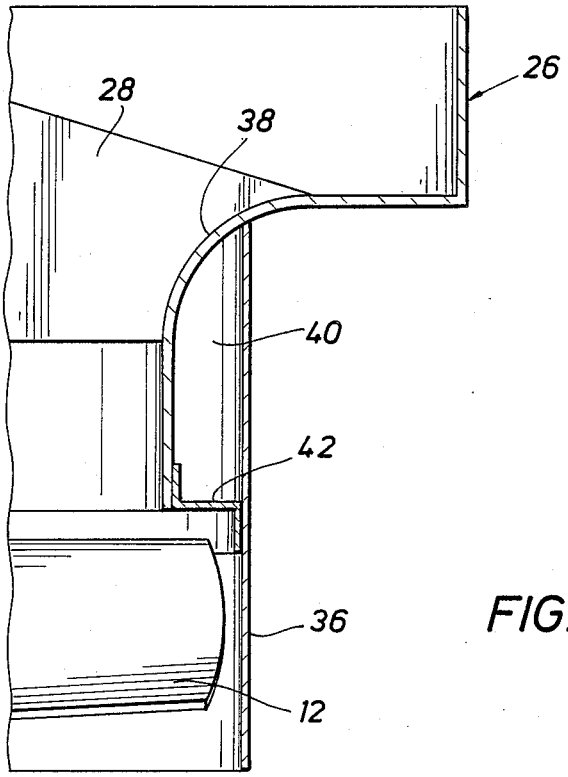
FIG. 4

SHROUD ASSEMBLY FOR AXIAL FLOW FANS

This application is a continuation-in-part of application Ser. No. 07/317,903, filed Mar. 2, 1989.

This invention relates to axial flow fans, generally, and in particular to an improved shroud assembly for such fans.

As the impeller blade of a fan moves through a fluid, such as air, pressures on opposite sides of the blade are different. This pressure differential will cause the fluid to flow over the tip of the blade from the discharge or high pressure side of the blade to the intake side or low pressure side of the blade thus forming a vortex. This reduces the efficiency of the fan. The conventional approach to reducing or preventing this flow of air, is to provide some sort of seal between the blade tip and the shroud, which usually involves reducing the clearance between the blade tip and the shroud to a minimum. For example, see Langenkamp et al U.S. Pat. No. 2,030,993 and Robb et al U.S. Pat. No. 4,406,581. Also see FIG. 7, where the importance of reducing tip clearance to improve fan efficiency is demonstrated.

The problem, however, is that it is very difficult to manufacture, ship, install, and operate satisfactorily a fan having a small clearance between the blades and the shroud, since it requires an almost perfect balancing of the rotating hub and blades, almost perfect centering of the rotating hub and blades in the shroud, and an almost perfectly round opening in the shroud. Therefore, as a practical matter, commercial fans are provided with enough tip clearance to operate even though the hub and blades are not perfectly balanced, the blades are not all the exact same length, the hub is not perfectly centered, and the opening in the shroud is not perfectly round. This compromise does, of course, reduce the efficiency of the fan.

It is an object of this invention to provide an axial fan having the efficiency of a low fan tip clearance fan without the problems described above.

It is a further object of this invention to provide an axial fan in which there is substantially no pressure differential between opposite sides of the blades adjacent the blade tips thereby substantially eliminating the flow of air over the blade tips and the forming of a vortex.

It is a further object of this invention to provide such an axial fan where the tips of the fan blades travel in a space where there is little or no movement of air thereby reducing substantially the effect of tip clearance on fan efficiency.

It is a further object of this invention to provide an axial fan having a shroud assembly that includes a cylindrical section or band that encircles the fan blades and is spaced therefrom and an orifice section having its downstream edge adjacent to but spaced from the impeller blades, which extend outwardly beyond the downstream edge of the orifice into a zone of non-moving air. The air moves out of the way of the blade tips, of course, but does not move much relative to the space through which the blade tips move.

U.S. Pat. No. 4,515,071, which issued to Elmer S. Zach on May 7, 1985 and is entitled "Ventilation Air Control Unit" discloses an axial fan having a shroud assembly that includes a cylindrical section or band that encircles the fan blades and is spaced therefrom and an orifice section having its downstream edge adjacent to but spaced from the impeller, which extend outwardly beyond the downstream edge of the orifice into a zone of non-moving air. This structural arrangement resulted when Zach replaced a twelve inch ventilating fan with a fourteen inch fan for forcing air into a grain drying and storing bin for drying and ventilating the grain in the bin.

Zach teaches use of a flange or orifice having an inner diameter less than the overall span of the fan blade for redirecting the flow of air away from the tips of the fan blade and toward its center (claim 4, lines 18 et seq.).

It is an object of this invention to provide an axial fan with an orifice, fan blade, and a band or cylindrical section encircling the fan blade and orifice, the diameters of which have a fixed relationship within a range and that substantially eliminates the flow of air over the tips of the fan blades which substantially reduces the effect of tip clearance on the efficiency of the fan, thereby allowing the tips of the fan blades to be spaced from the band sufficiently to avoid the manufacturing, shipping, installation, and operating problems described above.

Specifically, it is a further object and feature of this invention to provide an axial fan having an orifice, a fan blade, and a band wherein the diameter of the fan blade is about 103% of the diameter of the orifice and the diameter of the band is about 106% of the diameter of the orifice, which substantially eliminates the effect of tip clearance or fan efficiency and provides ample clearance between the tip of the fan blade and the band to substantially eliminate damage to the fan blade as a result of a reduction of such clearance in an effort to improve fan efficiency.

These and other objects, advantages, and features of this invention will be apparent to those skilled in the art from a consideration of this specification, including the attached drawings and appended claims.

IN THE DRAWINGS

FIG. 3 is a view of the intake side of the fan of FIG. 1.

FIG. 4 is a partial sectional view of an alternate embodiment of the invention.

Figure 5:
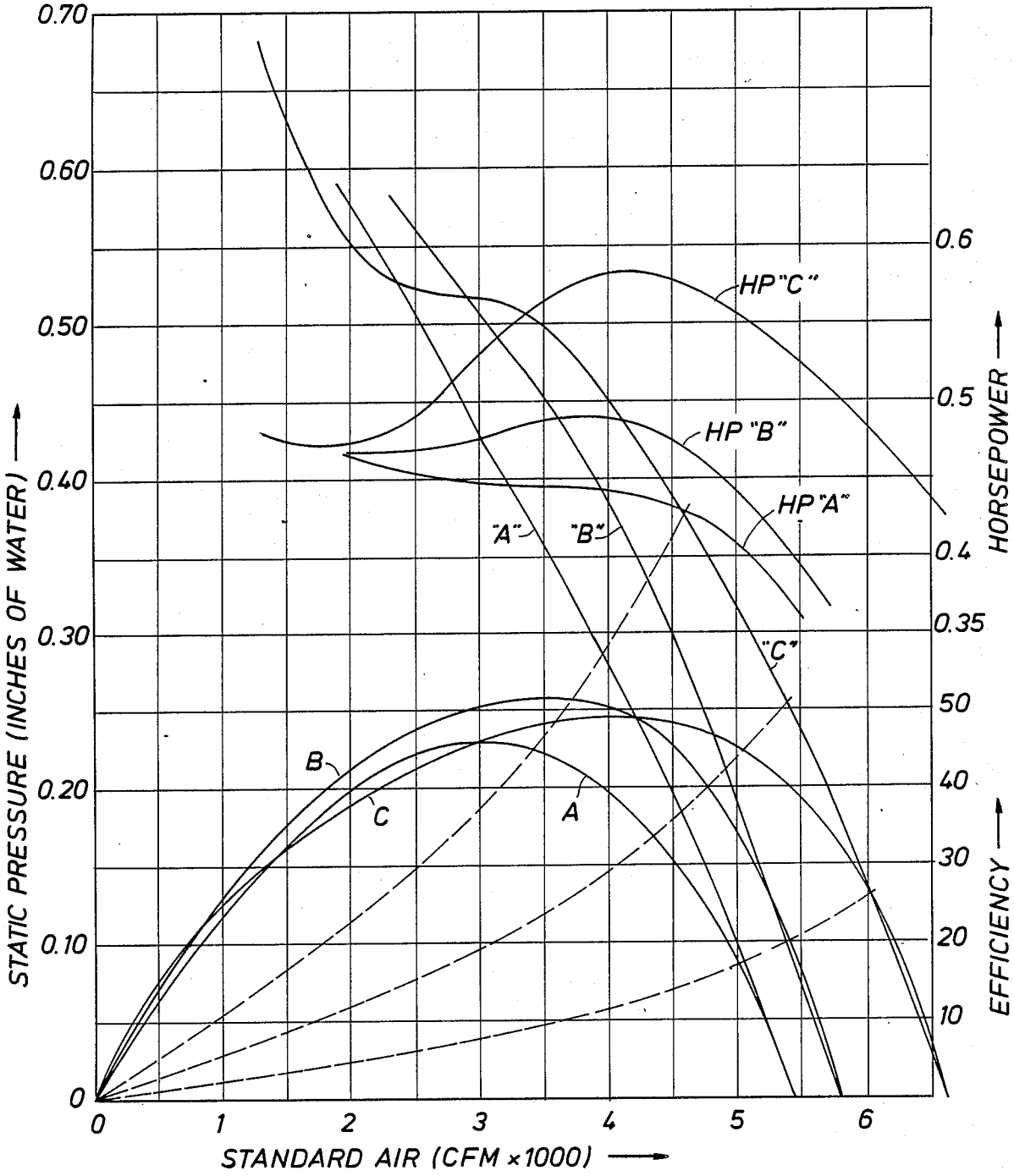
FIG. 5 is a graph of the performance data of three fans.
Figure 6A:
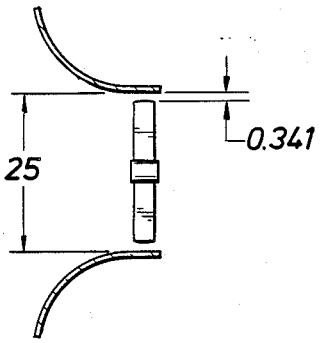
FIG. 6A (PRIOR ART)
Figure 6B:
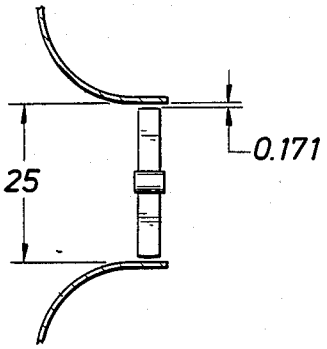
FIG. 6B (PRIOR ART)
Figure 6C:
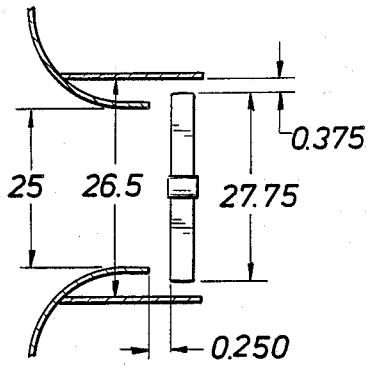

FIGS. 6A, 6B, and 6C show the arrangement of the fans and the shrouds that produced curves A, B, and C of FIG. 5, FIG. 6C being the fan that embodies this invention.

Figure 7:
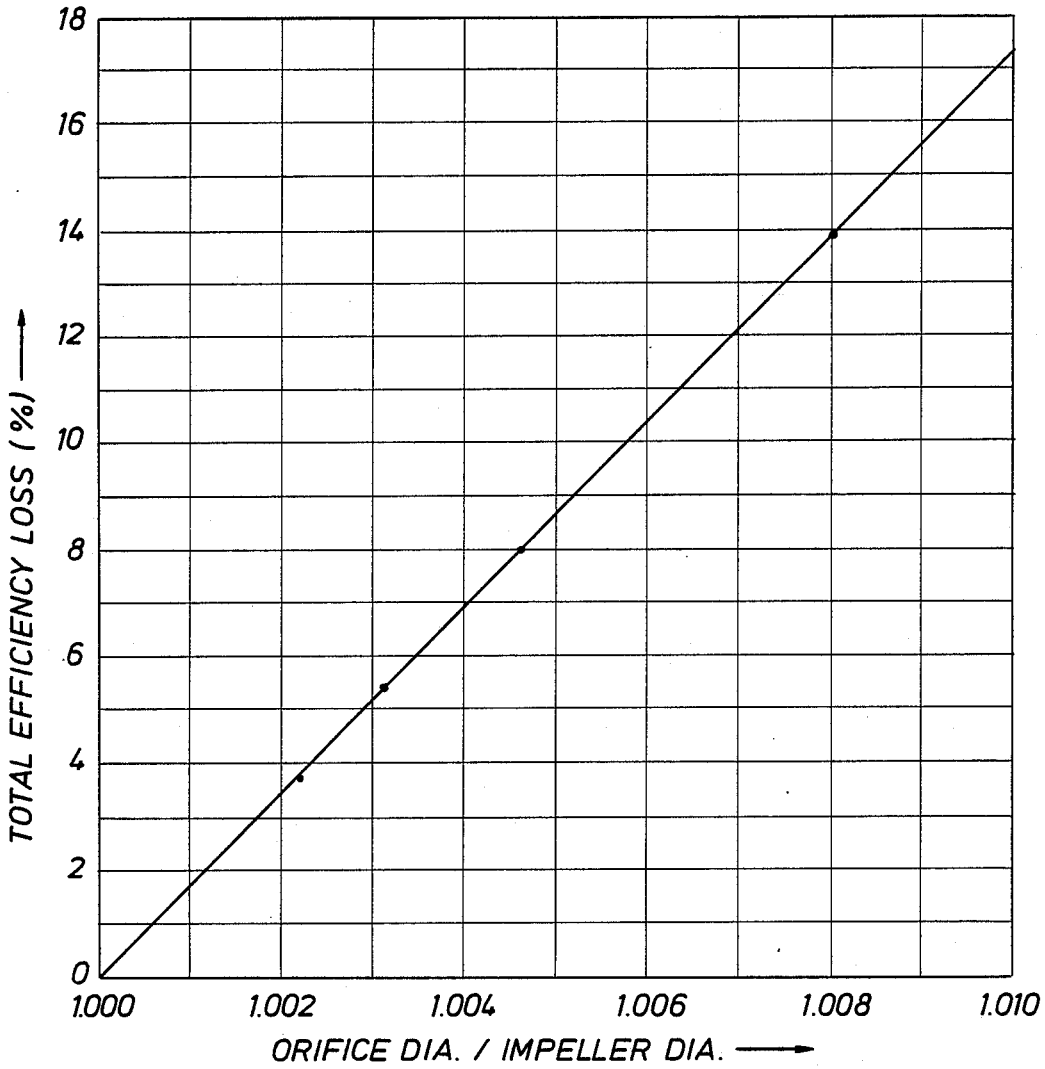

FIG. 7 is a graph showing the effect of tip clearance on fan efficiency.

Figure 1:
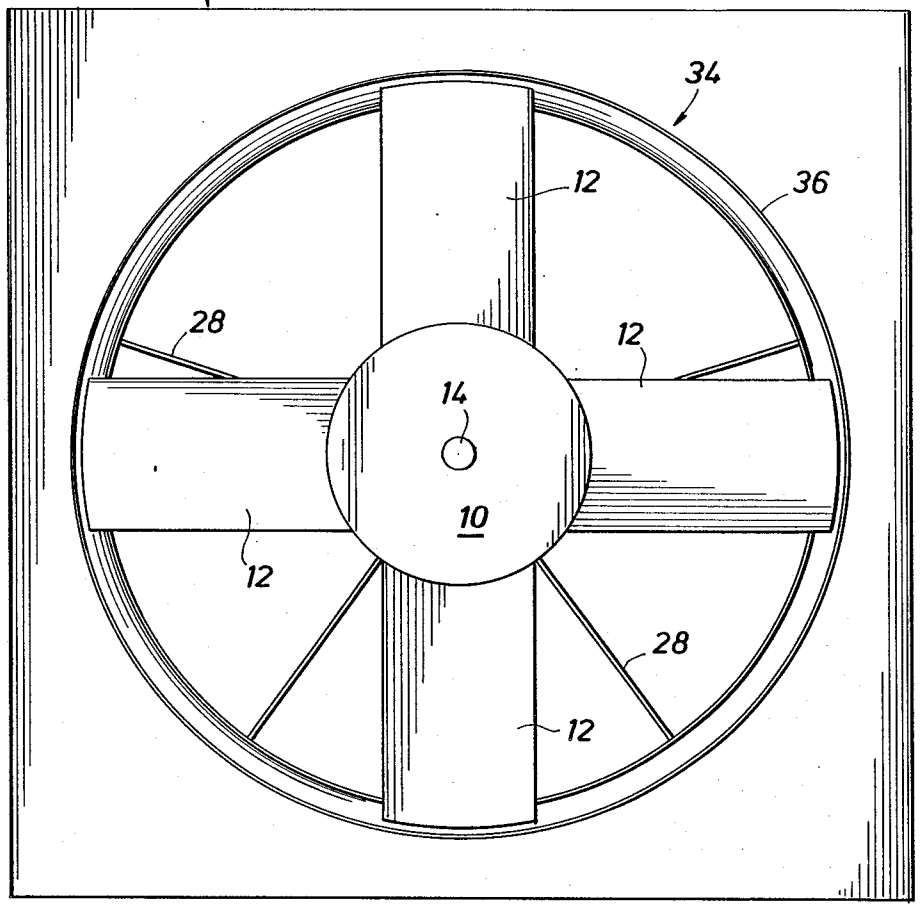
FIG. 1 is a view of the discharge side of a fan constructed in accordance with the preferred embodiment of this invention.
Figure 2:
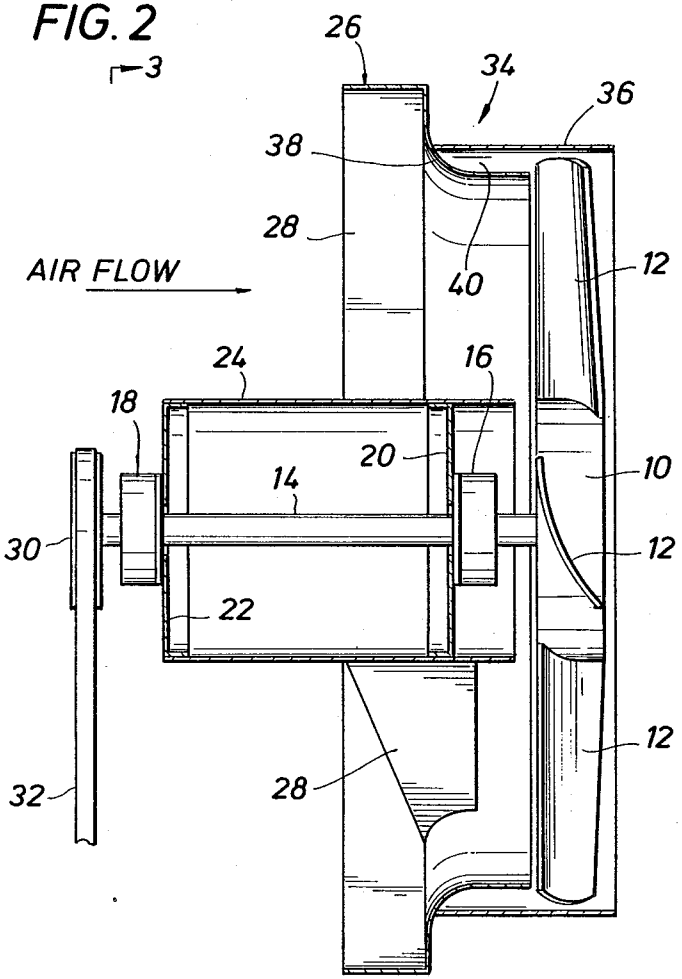
FIG. 2 is a sectional view taken along line 2—2 of FIG. 1.

The fan of FIGS. 1, 2, and 3 includes hub 10 to which four impeller blades 12 are attached. Preferably, the blades are curved along their transverse axes to provide concave surfaces facing the discharge side of the fan, as shown in FIG. 2. Hub 10 is mounted on shaft 14. The shaft is supported for rotation around its longitudinal axis by bearings 16 and 18 that are mounted on end plates 20 and 22 of bearing housing 24. The hub, the shaft, the bearings, and bearing housing are supported in the center of rectangular fan casing 26 by support vanes 28 that extend between the bearing housing and the fan casing. Sheave 30 mounted on shaft 14 on the outside of bearing housing 24 is rotated by belt 32 which in turn rotates hub 10 and the impeller blades. Belt 32 is driven by an electric motor that is usually mounted on the fan casing. The motor is not shown.

In accordance with this invention, the fan is provided with shroud assembly 34 that includes cylindrical section or band 36 and orifice section 38. The cylindrical section is attached to and supported by orifice section 38. The orifice section in turn is connected to rectangular fan casing 26. In the embodiment shown, the orifice section is an integral part of the front wall of the fan casing. It curves toward the center of the fan casing and rearwardly toward impeller blades 12, as shown, to provide a nozzle shaped guide for the air flowing through the fan. Although it need not do so, the orifice section shown straightens out and becomes cylindrical as it approaches the impeller blades to provide a section of uniform diameter through which the air flows before reaching the impeller blades.

In accordance with this invention, the impeller blades extend outwardly beyond the orifice section with the tips of the blades adjacent to but spaced from the cylindrical section of the shroud, as shown in FIG. 2. This arrangement provides annular space 40 between the orifice section and the cylindrical section in which the air does not move substantially. Consequently, there is little pressure differential between the sides of the impeller tips which results in substantially no radial flow of air over the tips of the blades. Therefore, there is no need for the tips of the blades to be close to the shroud to obtain the greatest efficiency for the fan. This is shown by the results of comparative tests on three fans, one of which being constructed in accordance with this invention.

The best method to use in evaluation of the improved performance of the fan of this invention (fan C), shown in curves "C" of the attached curve sheet, is the use of "system resistance" curves to make the performance of present technology (curves "A" and "B") equal the performance of the improved fan (curves "C"). Each fan had an orifice that was 25" in diameter.

As shown in FIGS. 6A, 6B, and 6C, the impeller blades of fan A are located inside the orifice with the blade tips spaced 0.341 inches from the orifice. Fan B also has its blades located inside the orifice, but the blade tips are much closer to the orifice, i.e., about 0.171 inches. Fan C has its shroud and blades positioned in accordance with this invention with the end of the orifice spaced about 0.75 inches from the cylindrical section, i.e., the cylindrical section has a diameter that is 106% of the diameter of the orifice. The fan blades extend beyond the orifice about 0.375 inches, i.e., the diameter of the blades is about 103% of the diameter of the orifice. The forward edge of each blade is about 0.25 inches from the end of the orifice. Obviously, substantial clearance is provided between the stationary and moving parts of the fan.

"System resistance" is the resistance to air flow when a fan or blower is attached to a fixed duct system. Changes in performance are then made by application of "fan laws". The "system resistance curves" in this instance are parabolic curves with the origin at zero for CFM and static pressure (Ps).

Table I below shows four different performances of fan C at four different static pressures (Ps). The static pressures were 0.000", 0.125", 0.250", and 0.375". Generally, 80% of commercial fan sales are for performances at static pressures (Ps) of 0.125" and 0.250", and 20% would be static pressures (Ps) of 0.000" (Free Air) and 0.375".

TABLE I

| Performance of Improved Fan (Curve "C") | | | | |
|---|---|---|---|---|
| CFM: | 6629 | 6050 | 5400 | 4600 |
| RPM: | 1150 | 1150 | 1150 | 1150 |
| Ps: | 0.000" | 0.125" | 0.250" | 0.375" |
| BHP: | 0.422 | 0.48 | 0.531 | 0.575 |
| Static Eff: | 0.0% | 24.8% | 40.0% | 47.2% |

Each of the four static pressures of fan C has a different "system resistance curve". These "system resistance" curves can be calculated by the following equation:

$$\text{cfm} = \text{constant}\sqrt{Ps} \tag{1}$$

or $$\frac{\text{cfm}}{\sqrt{Ps}} = \text{constant} \tag{2}$$

For curve "C", the constants are:

| | | | | |
|---|---|---|---|---|
| Ps: | 0.000 | 0.125" | 0.250" | 0.375" |
| Constant: | 0 | 17112 | 10800 | 7512 |

cfm is in cubic feet per minute
Ps (static pressure) is in inches of water

Three of these "system resistance curves" for Ps=0.125", 0.250", and 0.375" are plotted in dashed lines in FIG. 5.

The "system resistance curve" for Ps=0.000" (Free Air) is a special case because Ps=0. Therefore, the constant in the above equation is also equal to 0. Then:

$$\frac{\text{CFM of curve "}C\text{" @ } Ps = 0}{\text{CFM of curve "}A\text{" or "}B\text{" @ } Ps = 0} = K_1$$

$K_1 \times 1150$ = new RPM for curve "*A*" or "*B*"
$(K_1)^2 \times 0.000''$ = new *Ps* for curve "*A*" or "*B*" = 0
$(K_1)^3 \times$ BHP for curve "*A*" or "*B*" − new BHP for curve "*A*" or "*B*" @ New RPM FIG. 5 shows curves the Volume (CFM) vs Static Pressure (PS), Volume (CFM) vs Horsepower (BHP), and Static Efficiency vs Volume (CFM) for the fans of present technology (Curves "A" and "B") and the improved fan (Curve "C").

Calculated values of CFM and PS where the "system resistance curves" intersect the performance curves of "A" and "B" can be determined by applying constants of Curve "C" in equation (2). By consulting FIG. 5, the values of BHP are manually read from the Volume (CFM) vs Horsepower (BHP) curve, of FIG. 5, at the CFM calculated for the intersection of "system resistance curve" and Curves "A" and "B".

Curve "A" Performance Data at the Intersection of "System Resistance Curves" of Curve "C"

| | | | | |
|---|---|---|---|---|
| CFM | 5462 | 5047 | 4582 | 3989 |
| PS | 0.000" | 0.087" | 0.180" | 0.282" |
| BHP | 0.360 | 0.405 | 0.43 | 0.443 |

Curve "B" Performance Data at the Intersection of the "System Resistance Curves" of Curve "C"

| | | | | |
|---|---|---|---|---|
| CFM | 5769 | 5384 | 4902 | 4335 |
| PS | 0.000" | 0.099" | 0.206" | 0.333" |
| BHP | 0.369 | 0.405 | 0.446 | 0.481 |

There are certain well recognized engineering laws derived from engineering fundamentals that apply to all centrifugal and axial flow machinery performance. These are called "Fan laws" by those skilled in the art.

The "fan laws" are now employed to compare the performances of fans "A" and "B" (curves A and B) to the performance of fan C (curve "C") for the four static pressures shown in Table I.

The "fan laws" are in this instance:

Ratio of changes in RPM or Cfm$=K_1$

Ratio of changes in Static pressure$=(K_1)^2$

Ratio of changes in BHP$=(K_1)^3$

The comparison is made by moving data from curve "A" and curve "B" along "system resistance curves" to curve "C" by use of the "fan laws" as follows:

TABLE II

| Performance Data for Curve "A" and Upgraded to Curve "C" | | | | |
|---|---|---|---|---|
| CFM: | 5462 | 5047 | 4582 | 3989 |
| RPM: | 1150 | 1150 | 1150 | 1150 |
| Ps: | 0.000" | 0.087" | 0.180" | 0.282" |
| BHP: | 0.360 | 0.405 | 0.43 | 0.443 |
| Static Eff: | 0.0% | 17.1% | 30.2% | 40.0% |
| CFM & RPM-$K_1$: | $\left(\frac{6629}{5462}\right)=1.2137$ | $\left(\frac{6050}{5047}\right)=1.1987$ | $\left(\frac{5400}{4582}\right)=1.1785$ | $\left(\frac{4600}{3989}\right)=1.1517$ |
| Ps $(K_1)\alpha$: | $\left(\frac{6629}{5462}\right)^2=1.4730$ | $\left(\frac{6050}{5047}\right)^2=1.4370$ | $\left(\frac{5400}{4582}\right)^2=1.3889$ | $\left(\frac{4600}{3989}\right)^2=1.3298$ |
| BHP $(K_1)\beta$: | $\left(\frac{6629}{5462}\right)^3=1.7877$ | $\left(\frac{6050}{5047}\right)^3=1.7225$ | $\left(\frac{5400}{4582}\right)^3=1.6369$ | $\left(\frac{4600}{3989}\right)^3=1.5355$ |
| CFM: | 6629 | 6060 | 5400 | 4600 |
| RPM: | (+21.3%) 1396 (+19.8%) | 1378 (+17.8%) | 1355 (+15.2%) | 1326 |
| Ps: | 0.000" | 0.125" | 0.25" | 0.375" |
| BHP: | (+52.4%) 0.643 (+45.4%) | 0.698 (+32.5%) | 0.704 (+18.1%) | 0.679 |
| Static Eff: | 0.0% (−31.2%) | 17.1% (-31 24.5%) | 30.2% (−8.5%) | 40.0% |

Evaluation of Table II shows that fan A at 0.000" (Free Air) had increased RPM by 21.3% and required more power, BHP, by 52.4%. Similar but lower increases were shown for the other static pressures: 0.125", 0.250", and 0.375". The loss in static efficiency was 31.2% at 0.125" static pressure, 24.5% at 0.250" static pressure, and 8.5% at 0.375" static pressure.

Table III shows the result when data from curve "B" is moved to equal the performance of curve "C".

TABLE III

| Performance Data From Curve "B" and Upgraded to Curve "C" | | | | |
|---|---|---|---|---|
| CFM: | 5769 | 5384 | 4902 | 4335 |
| RPM: | 1150 | 1150 | 1150 | 1150 |
| Ps: | 0.000" | 0.099" | 0.206" | 0.333" |
| BHP: | 0.369 | 0.405 | .446 | .481 |
| Static Eff: | 0.0% | 20.7% | 35.79% | 47.2% |
| CFM & RPM: | $\left(\frac{6629}{5769}\right)=1.1491$ | $\left(\frac{6050}{5084}\right)=1.1237$ | $\left(\frac{5400}{4902}\right)=1.1016$ | $\left(\frac{4600}{4335}\right)=1.0611$ |
| Ps: | $\left(\frac{6629}{5769}\right)^2=1.3204$ | $\left(\frac{6050}{5384}\right)^2=1.2627$ | $\left(\frac{5400}{4902}\right)^2=1.2135$ | $\left(\frac{4600}{4335}\right)^2=1.1260$ |
| BHP: | $\left(\frac{6629}{5769}\right)^3=1.5172$ | $\left(\frac{6050}{5384}\right)^3=1.4189$ | $\left(\frac{5400}{4902}\right)^3=1.3368$ | $\left(\frac{4600}{4335}\right)^3=1.1948$ |
| CFM: | 6629 | 6050 | 5400 | 4600 |
| RPM: | (+14.9%)1321 (+12.3%) | 1292 (+10.2%) | 1269 (+6.1%) | 1220 |
| Ps: | 0.000" | 0.125" | 0.250" | 0.375" |
| BHP: | (+32.7%)0.560 (+19.8%) | 0.575 (+7.2%) | 0.596 | 0.575 |
| Static Eff: | 0.0% (−16.5%) | 20.7% (−10.7%) | 35.79% | 47.2% |

Evaluation of Table III shows that fan "B" at 0.000" (Free Air) had increased RPM by 14.9% and required 32.7% more power, BHP. Similar but lower increases were shown for static pressures of 0.125" and 0.250". At the 0.375" static pressure, however, only the RPM increased by 6.1%. Increased RPM will increase the noise level.

Tables II and III show clearly that reduction in tip clearance of the present technology will bring increased efficiencies, but this also brings on a problem of how to effectively manufacture such equipment and ship to the ultimate user.

The improved fan of this invention allows for acceptable manufacturing tolerances without loss of performance.

SUMMARY

Tables IV and V shown below are summaries of all percentage changes in performance when curves "A" and "B" are made equal in performance to curve "C".

TABLE IV

Percentage Change to Make Curve "A" Equal Curve "C"

For Curve "A":

| Static pressure of Curve "C" | 0.000" | 0.125" | 0.250" | 0.37" |
|---|---|---|---|---|
| CFM | +21.37% | +19.87% | +17.85% | +15.17% |
| RPM | +21.37% | +19.87% | +17.85% | +15.17% |
| Ps | +47.30% | +43.7% | +38.89% | +32.99% |
| BHP | +52.4% | +45.4% | +32.5% | +18.1% |
| Static Eff. | none | −31.1% | −24.5% | −8.5% |

TABLE V

Percentage Change to Make Curve "B" Equal Curve "C"

For Curve "B":

| Static pressure of Curve "C" | 0.000" | 0.125" | 0.250" | 0.375" |
|---|---|---|---|---|
| CFM | +14.91% | +12.37% | +10.16% | +6.11% |
| RPM | +14.91% | +12.37% | +10.16% | +6.11% |
| Ps | +32.04% | +26.27% | +31.35% | +12.6% |
| BHP | +32.7% | +19.8% | +7.2% | none |
| Static Eff. | none | −16.5% | −10.7% | none |

FIG. 4 is an alternate embodiment of this invention. Structurally, it is the same as the embodiment in FIGS. 1, 2, and 3 with the addition of annular bracket 42 to support and connect the rearward edge of the orifice section to the cylindrical section. This embodiment does not perform as well as the preferred embodiment, but better than fans A and B.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. An axial fan comprising a hub, means supporting the hub for rotation around the longitudinal axis of the fan, a plurality of impeller blades attached to the hub and extending radially from the axis of rotation, a shroud assembly including a band encircling the blades and spaced from the tips of the blades a sufficient distance to provide ample clearance to avoid contact between the blades and the band during shipment and operation of the fan, said shroud further including an orifice positioned upstream of the blades, said band having a diameter that is about 106% of the diameter of the orifice means for preventing air from flowing between the orifice and the band, said orifice having a downstream end located adjacent to but spaced from the impeller blades, said impeller blades having a diameter that is about 103% of the diameter of the orifice so that the impeller blades extend outwardly from the hub beyond the orifice to reduce the flow of air over the tips of the impeller blades substantially while providing ample clearance between the tips of the impeller blades and the band.

2. An axial fan comprising, a rotatable fan hub, a plurality of impeller blades carried by the hub, a fan casing for supporting the hub and blades, said casing further supporting a fan blade shroud assembly including a cylindrical band that extends from the casing over the blades and an orifice that decreases to a diameter less than the diameter of the circular path of the tips of the blades and extends to a position adjacent to but spaced from the blades to combine with the band to provide an annular space having little or no air movement in which the tips of the blades move as the blades are rotated to thereby reduce substantially the radial flow of air over the tips of the impeller blades and thereby increase the efficiency of the fan, the diameter of the band being about 106% of the diameter of the orifice and the diameter of the blades being about 103% of the diameter of the orifice.

3. The axial fan of claim 2 in which the impeller blades are spaced from the end of the orifice about 0.250 inches.

* * * * *

UNITED STATES PATENT AND TRADEMARK OFFICE

CERTIFICATE OF CORRECTION

PATENT NO. : 4,927,328

DATED : May 22, 1990

INVENTOR(S) : William D. Scoates and Samuel W. Scoates

It is certified that error appears in the above-identified patent and that said Letters Patent is hereby corrected as shown below:

ON THE TITLE PAGE: In the illustrative figure and in Figure 6C, change "27.75" to --25.75--.

Signed and Sealed this

Twenty-seventh Day of August, 1991

*Attest:*

*Attesting Officer*

HARRY F. MANBECK, JR.

*Commissioner of Patents and Trademarks*